United States Patent [19]

Grenell

[11] 4,444,324

[45] Apr. 24, 1984

[54] COMPARTMENTED STORAGE CONTAINER

[76] Inventor: David J. Grenell, 1396 Hadden Cir., Akron, Ohio 44313

[21] Appl. No.: 430,705

[22] Filed: Sep. 30, 1982

[51] Int. Cl.[3] ..... B65D 1/04; B65D 81/38; A45C 11/20; A47J 41/00

[52] U.S. Cl. ..... 215/6; 206/545; 215/13 R; 220/215; 220/4 D

[58] Field of Search ..... 215/6, 13 R, 1 R; 220/215, 4 D, 4 C, 23.4, 23.83 AE, 339; 206/545

[56] References Cited

U.S. PATENT DOCUMENTS

| | | | |
|---|---|---|---|
| 880,082 | 2/1908 | Kendrick | 215/6 |
| 941,303 | 11/1909 | Borden | 220/4 D |
| 2,110,237 | 3/1938 | Parsons | 215/6 |
| 2,326,414 | 8/1943 | Thompson | 215/6 |
| 2,328,543 | 9/1943 | Bauman | 215/1 R |
| 2,833,436 | 5/1958 | Ruderian | 215/6 |
| 2,954,893 | 10/1960 | Sayre | 220/215 |
| 3,327,881 | 6/1967 | Maier | 215/6 |
| 3,369,691 | 2/1968 | Wei | 220/4 D |
| 3,384,259 | 5/1968 | Hoffstadt | 206/545 |
| 3,410,444 | 11/1968 | Morane | 215/6 |
| 3,465,905 | 9/1969 | Schottanes | 215/6 |
| 3,485,416 | 12/1969 | Fohrman | 220/339 |
| 3,744,622 | 7/1973 | Weaver | 215/6 |
| 4,336,891 | 6/1982 | Smith | 215/100 R |

*Primary Examiner*—Steven M. Pollard
*Assistant Examiner*—Bryon Gehman
*Attorney, Agent, or Firm*—Mack D. Cook, II

[57] ABSTRACT

Two embodiments of a compartmented storage container for liquids or foods. In both embodiments, the containers have two identical juxtaposed cylindrical body members with insulated walls, open base ends and dispensing openings closed by a removable insulated closure. The open base ends are interconnected by a medial connector with an insulated annular flange. In one embodiment, for storing two different liquids or foods in one container, the medial connector is closed. In the other embodiment, for storing one liquid or food in one container, the medial connector is open.

3 Claims, 10 Drawing Figures

COMPARTMENTED STORAGE CONTAINER

BACKGROUND OF THE INVENTION

The present invention relates to an article of manufacture intended for use as a compartmented storage container. The invention enables a user to store, transport and consume either two quantities of different nutrient or beverage liquids or foods or a large quantity of the same liquid or food.

Relevant prior art compartmented storage containers are to be found in Class 215/Subclass 6.

Illustrative of relevant prior art are U.S. Pat. Nos. 880,082, Feb. 1980, Kendrick; 2,110,237, Mar. 1938, Parsons; 2,326,414, Aug. 1943, Thompson; 2,833,436, May 1958, Ruderian; 3,410,444, Nov. 1968, Morane; and 4,336,891, June 1982, Smith.

SUMMARY OF THE INVENTION

It is an object of the invention to provide an improved compartmented storage container for nutrient or beverage liquids or foods and particularly suited for every day use with different quantities and kinds of liquid or food.

It is a further object of the invention to provide a storage container which may be readily taken apart for dishwashing and cleaning so that yesterday's liquid or food will not contaminate today's choice.

Still further, it is an object of the invention to provide a storage container which is assembled using three identical components, cups, closures and bodies or barrels, and either of two medial connectors: Components which may be produced at low cost and sold at a reasonable price, with insulative factors, with color and decoration, and with resistance to mechanical forces or shock anticipated during normal use.

These and other objects of the invention will become apparent in view of the drawings and the detailed description.

In general, a container according to the invention stores liquids or foods in either of two insulated compartments defined by two cylindrical body members having juxtaposed and open base ends. The top of each body member has a dispensing opening. Each dispensing opening has a removable insulating closure. The juxtaposed and open body member base ends are interconnected by a medial connector. A medial connector has an insulated annular flange with an outer diameter conforming generally to the outer diameter of the body member base ends and with a thickness permitting manual rotation and manipulation thereof by a user of the container. A connector flange carries two oppositely directed closure rings. Each closure ring has external threads for mating engagement with internal threads around the openings in the body member base ends.

The container as described next above is generic to two embodiments of the invention. In the first embodiment, each closure ring carried by a medial connector flange carries a circular plate defining a hollow baffle between the interconnected body members. The chamber formed by the hollow baffle has an insulation factor.

THE DRAWINGS

DETAILED DESCRIPTION OF THE INVENTION

Figure 1:
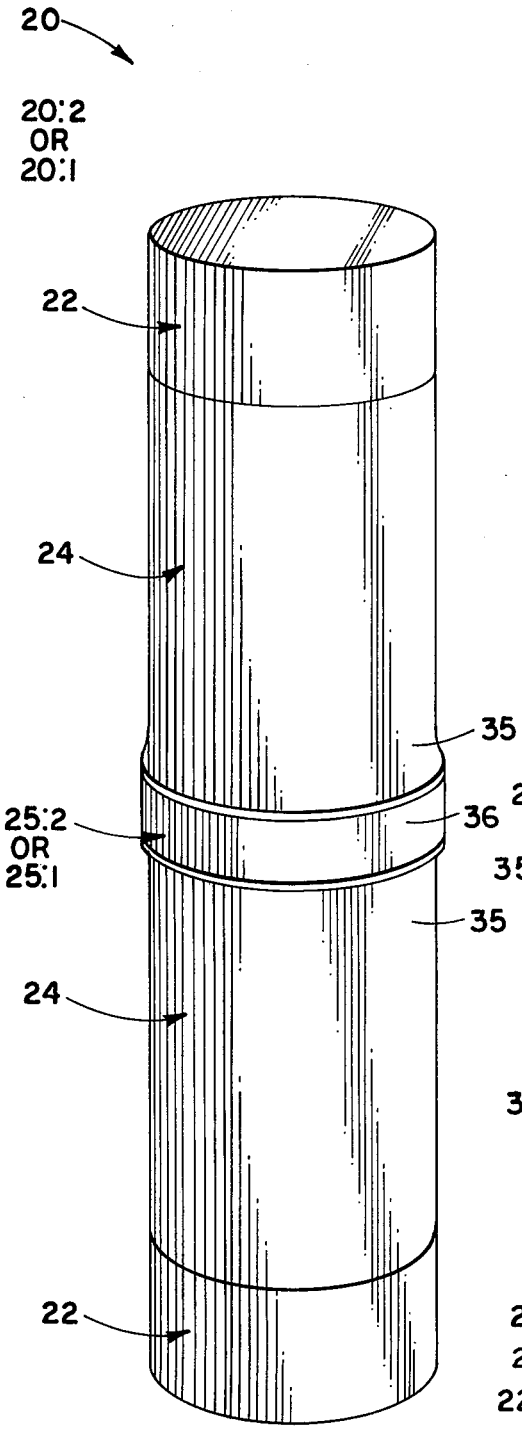
FIG. 1 is a perspective of a storage container.
Figure 2:
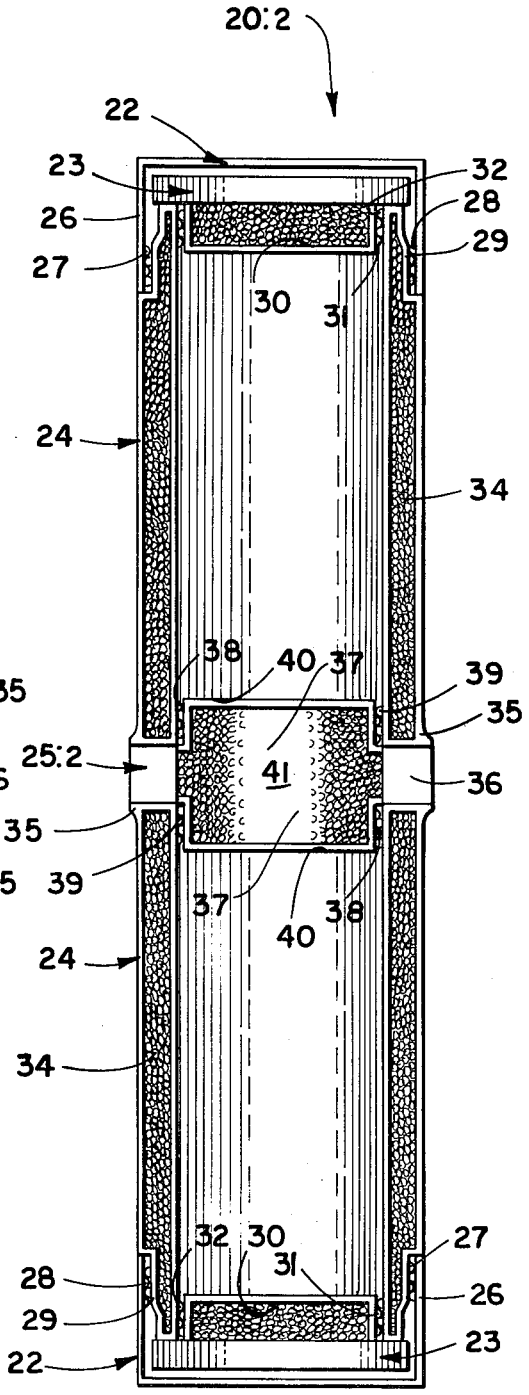
FIG. 2 is a full sectional view of the first embodiment of FIG. 1.

A two compartment storage container according to the invention is referred to generally by the numeral 20. The first embodiment of the invention, a divided storage container, is referred to as 20:2 and is shown in detail in FIGS. 2–5. The second embodiment of the invention, an undivided storage container, is referred to as 20:1 and is shown in detail in FIGS. 7–10.

Either storage container 20 is generally cylindrical and elongate and comprises two cups 22, two closures 23, and two body members or barrels 24. Each cup 22, closure 23 and body member 24 are preferably indentical in functional configuration so as to be interchangeable during assembly of a container 20. The two container body members 24 are interconnected by a medial connector 25; either a divider or closed connector 25:2 or a flow-through or open connector 25:1.

As shown, each cup 22 is carried coaxially over a closure 23 and has a side wall 26 with integrally formed internal threads 27 for mating engagement with integrally formed external threads 28 around a reduced diameter neck 29 on the top end of a body member 24. Use of mating threads 27–28 is preferred, although a cup 22 and a body member 24 could be adapted for interconnection by a sliding friction engagement.

As shown, each closure 23 has an insulated plug end 30 with integrally formed external threads 31 for mating engagement with integrally formed internal threads 32 around the liquid or food dispensing opening defined by the body member neck 29. Use of mating threads 31–32 is preferred, although a closure 23 and a body member 24 could be adapted for interconnection by a sliding friction engagement.

A container body member 24 must be an insulator, forming a barrier to transmission through the body side wall of heat from within or cold from without, for a reasonable period of time. A body member 24 must also be resistant to mechanical forces or shock anticipated during normal use. As shown the body member 24 has a double side wall configuration defining an insulative chamber 34. Preferably, the body chamber 34 is filled with a suitable discrete material having a high insulation factor.

According to the invention, a medial connector 25, positively and selectively interconnects the juxtaposed open base ends 35 of two body members 24. A medial connector 25 has an annular flange 36. A connector flange 36 must have an outer diameter conforming generally to the outer diameter of the body member base ends 35, a thickness permitting manual rotation and manipulation thereof by the user and an insulation factor.

A connector flange 36 carries two oppositely directed closure rings 37. As shown, each closure ring 37 has integrally formed external threads 38 for mating engagement with integrally formed internal threads 39 around the opening defined by a body member base end 35. It is conceived that the use of mating threads 38–39 providing a mechanical lock for interconnection of two body members 24 is mandatory. A construction providing only for sliding friction engagement between a medial connector 25 and two body members 24 would be unsatisfactory.

Figure 3:
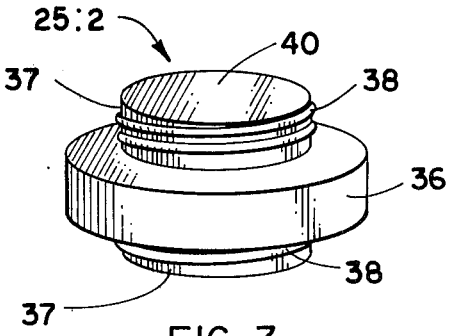
FIGS. 3, 4 and 5 are, respectively, a perspective, a side elevation and a plan view of the medial connector for the storage container of FIG. 2.
Figure 4:
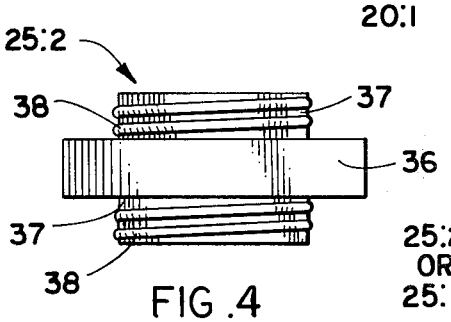
Figure 5:
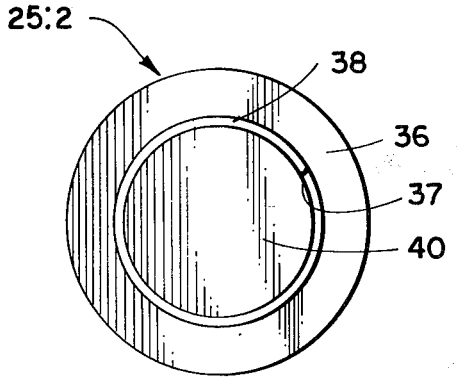
Figure 6:
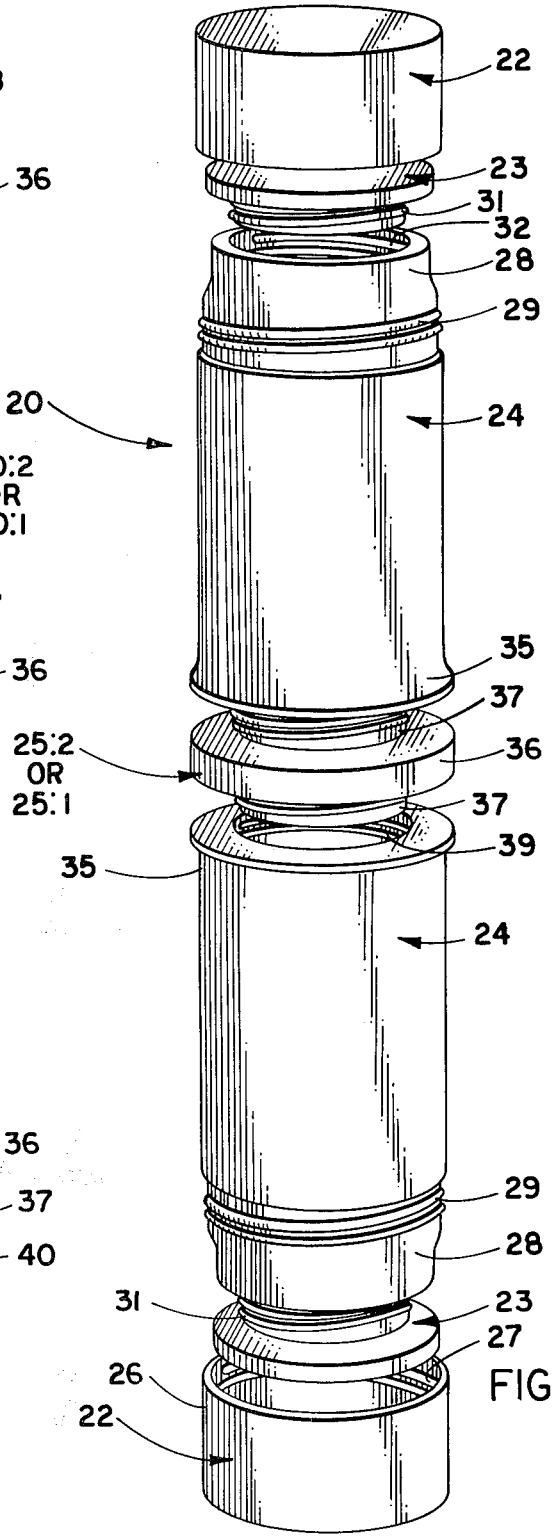
FIG. 6 is an exploded perspective of the storage container of either FIG. 2 or FIG. 7.
Figure 7:
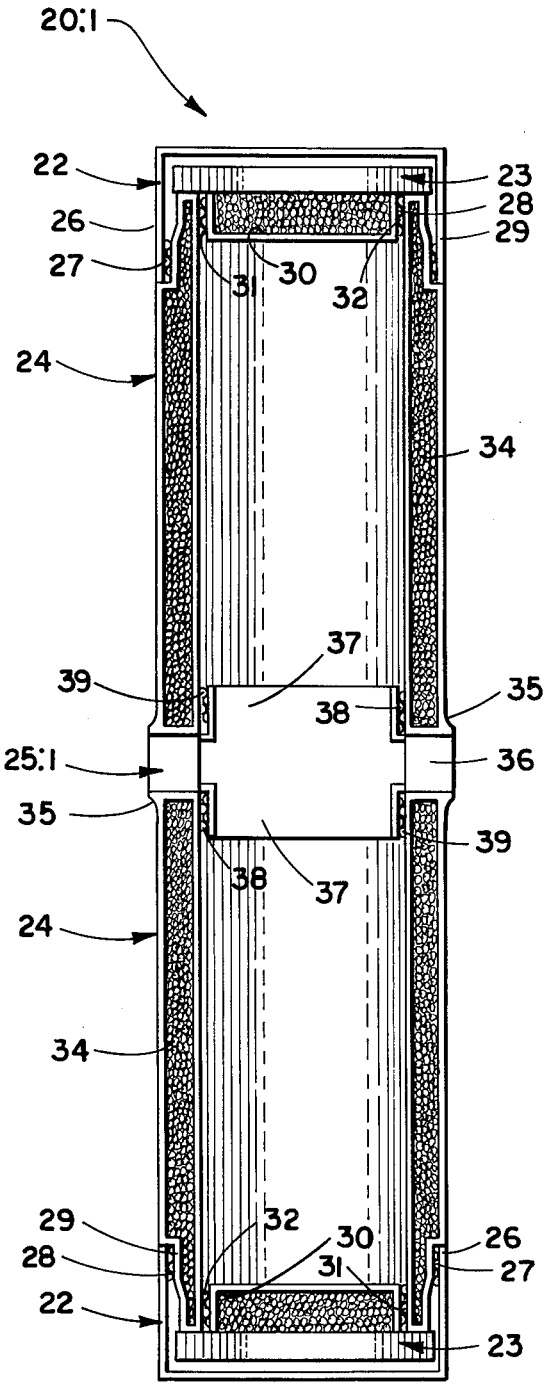
FIG. 7 is a full sectional view of the second embodiment of the storage container having the outer configuration of FIG. 1.
Figure 8:
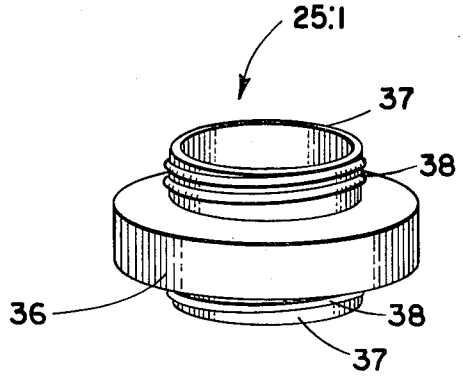
FIGS. 8, 9 and 10 are, respectively, a perspective, a side elevation and a plan view of the medial connector for the storage container of FIG. 7.
Figure 9:
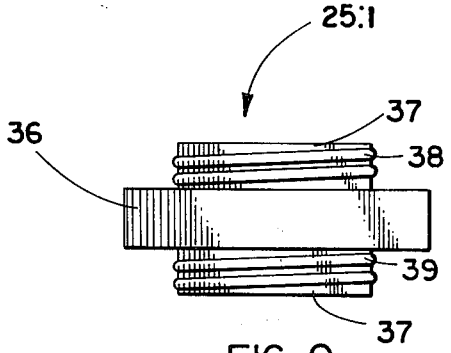
Figure 10:
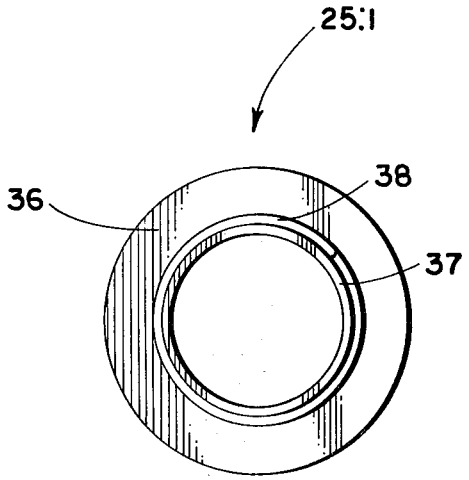

Referring to FIGS. 3–5, a divider or closed connector 25:2 has a circular closure plate 40 carried by each closure ring 37 defining a hollow baffle between two interconnected body members 24. The chamber 41 formed by the hollow baffle is insulative and is preferably filled with a suitable discrete material having a high insulation factor.

Assembly of a container 20 in the 20:2 configuration will enable the user to store, transport and consume a different liquid or food in each compartment. For example, a mother could send her child off to school with hot soup and milk; a couple could have coffee with cream and tea with lemon. If the user wants one liquid or food, a large quantity thereof may be stored by assembly of a container 20 in the 20:1 configuration.

What is claimed is:

1. A container for storing liquids or foods in either of two compartments defined by two insulated cylindrical body members having juxtaposed and open base ends, the top end of each said body member having a dispensing opening, each said dispensing opening having a removable insulated closure, said body member open base ends being interconnected by a medial connector, said medial connector having an insulated annular flange with an outer diameter conforming generally to the outer diameter of said body member base ends and with a thickness permitting manual rotation and manipulation thereof, said connector flange carrying two oppositely directed closure rings, each said closure ring having external threads for mating engagement with internal threads around said openings in said body member base ends.

2. A container according to claim 1, wherein each said closure ring carried by said medial connector flange carries a circular plate defining a hollow baffle between said open ends of said interconnected body members, the chamber formed by said hollow baffle being insulative.

3. A container according to claim 1, wherein each said body member carries a cup coaxially over each said dispensing opening closure.

* * * * *